US008512011B2

(12) United States Patent
Larsson et al.

(10) Patent No.: US 8,512,011 B2
(45) Date of Patent: Aug. 20, 2013

(54) FLUID PUMP AND FUEL DISPENSER

(75) Inventors: Bengt I. Larsson, Skivarp (SE); Marie Hakansson, Malmo (SE)

(73) Assignee: Dresser, Inc., Addison, TX (US)

( * ) Notice: Subject to any disclaimer, the term of this patent is extended or adjusted under 35 U.S.C. 154(b) by 1364 days.

(21) Appl. No.: 11/960,299

(22) Filed: Dec. 19, 2007

(65) Prior Publication Data

US 2008/0164287 A1 Jul. 10, 2008

(30) Foreign Application Priority Data

Dec. 19, 2006 (EP) ..... 06026312
Dec. 19, 2006 (EP) ..... 06026313
Mar. 14, 2007 (EP) ..... 07104125

(51) Int. Cl.
*F04B 35/04* (2006.01)
*F04B 17/04* (2006.01)

(52) U.S. Cl.
USPC ..... 417/418

(58) Field of Classification Search
USPC ..... 417/410, 416, 418, 420; 310/15; 318/119
See application file for complete search history.

(56) References Cited

U.S. PATENT DOCUMENTS 2,515,110 A 5/1949 Bornstein
3,754,154 A * 8/1973 Massie ..... 310/30
3,826,291 A 7/1974 Steffens
4,223,706 A * 9/1980 McGahey ..... 141/59
4,353,220 A 10/1982 Curwen et al.
4,750,871 A 6/1988 Curwen
5,106,268 A 4/1992 Kawamura et al.
5,123,817 A 6/1992 Willemsen
5,957,113 A 9/1999 Masaki et al.
6,899,149 B1 * 5/2005 Hartsell et al. ..... 141/192
2005/0053490 A1 3/2005 Bahnen et al.
2005/0112001 A1 * 5/2005 Bahnen et al. ..... 417/418
2006/0127252 A1 * 6/2006 Caddell ..... 417/418

FOREIGN PATENT DOCUMENTS

DE 2409298 A1 9/1975
DE 3046048 A1 8/1982
DE 4015780 A1 11/1990
EP 0106414 A2 4/1984

(Continued)

OTHER PUBLICATIONS

European Search Report for EP 06026312.6 mailed Jun. 19, 2007. (7 pages).

(Continued)

*Primary Examiner* — Devon Kramer
*Assistant Examiner* — Amene Bayou
(74) *Attorney, Agent, or Firm* — Hiscock & Barclay LLP

(57) ABSTRACT

A fluid pump for a fuel dispensing unit comprises a pump housing with a first chamber and a second chamber, each chamber having a fluid inlet valve and a fluid outlet valve, respectively. The chambers are separated by a movable piston arranged to repeatedly decrease and increase the volumes of the chambers. The piston comprises a magnetic device, and an electromagnetic control configured to move the piston by altering a magnetic field, for repeatedly decreasing and increasing the volume of the chambers. A controllable fluid flow passage connected to first chamber and to the second chamber that allows fluid to pass from the first chamber to the second chamber without passing through the any of the fluid inlet valves or the fluid outlet valves so that when there is a flow of fuel from the first chamber to the second chamber via the fluid flow passage and when the piston moves towards the first side the first outlet valve and the second inlet valve remain closed during operation.

21 Claims, 5 Drawing Sheets

(56) References Cited

FOREIGN PATENT DOCUMENTS

| | | | |
|---|---|---|---|
| EP | 1783368 | A1 | 5/2007 |
| EP | 1936189 | | 6/2008 |
| EP | 1936193 | | 6/2008 |
| JP | 52060403 | A | 5/1977 |
| WO | 93/162297 | | 8/1993 |

OTHER PUBLICATIONS

European Search Report for EP 06026313.4 mailed Jun. 22, 2007. (7 pages).
European Patent Application No. EP 07104125.5: European Search Report dated Jul. 13, 2007, 3 pages.

* cited by examiner

FLUID PUMP AND FUEL DISPENSER

REFERENCE TO PRIORITY APPLICATIONS

The present application claims the benefit of priority under 35 U.S.C. §119 to European Patent Application No. 06026312.6 filed on Dec. 19, 2006, European Patent Application No. 06026313.4 filed Dec. 19, 2006, and European Patent Application No. 07104125.5 filed Mar. 14, 2007.

TECHNICAL FIELD

The present invention relates to a fluid pump and fuel dispenser for efficiently transporting fluid to and from a tank of a vehicle.

BACKGROUND ART

When filling the fuel tank of a motor vehicle, a fuel pump arranged inside a fuel dispenser generates a stream of fuel from a fuel storage tank to the fuel tank of the vehicle. The fuel pump which must be able to pump liquid, flammable fuel, is a main component of the fuel dispenser. It is relatively expensive and requires a lot of room inside the fuel dispenser.

Moreover, it is a common measure to recover the vapor escaping the tank when filling it with the liquid fuel. This measure is taken for both safety and environmental reasons, since the fuel vapors are flammable and constitute a health hazard. The vapor recovery is achieved, for instance, by arranging a vapor suction nozzle next to a fuel dispensing nozzle of a pistol grip that is used for filling the tank with fuel. Vapor is then removed from the tank during filling, at a certain rate, which is often controlled by the standard rate. Vapor recovery systems typically comprise a pump for removing fuel vapor, from the tank of the vehicle, by suction and feeding it back to the fuel container from which the fuel is fed to the vehicle. This mutual exchange of vapor/fuel is continuously performed when filling a vehicle with fuel. Accordingly, at least two pumps are arranged in the fuel dispenser, i.e. the fuel pump for transporting the liquid fuel and the vapor recovery pump for transporting the gaseous fuel vapor.

A problem associated with prior art, in respect of both fuel pumps and vapor recovery pumps, is relatively high production costs due to complex arrangements. Maintenance is cumbersome and many of the techniques are sensitive to leakage of fluid past the piston. Another problem is that some of the arrangements are rather bulky and takes a lot of space when mounted inside a fuel dispensing unit.

SUMMARY OF THE INVENTION

It is an object of the present invention to provide an improvement over the prior art, which is achieved by a fluid pump that comprises a piston with an integrated magnetic device, and an electromagnetic controller configured to move the piston by altering a magnetic field.

Other objects and advantages that will be apparent from the following description of the present invention are achieved by a fluid pump and a fuel dispensing unit according to the following description.

The pump according to the invention may be used for pumping fluid fuel, i.e. either liquid fuel, e.g. when filling the fuel tank of a motor vehicle, or for pumping gaseous fuel vapor, e.g. for recovering fuel vapor displaced from the fuel tank of a motor vehicle when filling the fuel tank thereof. In view hereof; and to simplify the following description and claims, the expression "fluid pump" is used as a generic term intended to cover the use as a pump for liquid fuel as well as the use as a pump for gaseous fuel vapor recovery. According to a particular aspect, the pump may be used simultaneously for vapor recovery and for pumping fuel.

Accordingly, a fluid pump for a fuel dispensing unit is provided, comprising a pump housing with a first chamber and a second chamber, each chamber having a fluid inlet valve and a fluid outlet valve, respectively, the chambers being separated by a movable piston arranged to repeatedly decrease and increase the volumes of the chambers. The piston comprises a magnetic device, and an electromagnetic controller is configured to move the piston by altering a magnetic field, for repeatedly decreasing and increasing the volume of the chambers.

The movable piston may have a first-side facing the first chamber and a second side facing the second chamber, wherein the magnetic device is arranged between the two sides of the piston which provides a compact design of the fluid pump.

The two sides of the piston may each pass a common point along the direction of movement of the piston, when the volumes of the chambers are repeatedly decreased and increased, which results in increased pumping efficiency in respect of the total effective chamber size.

The greatest cross sectional area of the piston, in a plane along the direction of movement of the piston, should be smaller than the cross sectional area of any of the first chamber and the second chamber. This provides a very compact pump housing.

The pump housing may comprise a plurality of coils fed by a current for moving the piston, the electromagnetic controller being configured to repeatedly vary currents levels applied to the plurality of coils, so that the movement of the piston is controllable in respect of its location and speed. This facilitates versatile movement of the piston, such as setting the piston in order to describe a sinusoidal speed vs. time curve, which results in a smooth movement of the piston and reduced wear.

The coils may be circumferential to each of the two chambers, for making the fuel pump even more compact.

The magnetic device may be a permanent magnet, which offers a cost efficient solution.

The fuel pump may further comprise a controllable fluid flow passage connecting the first chamber with the second chamber, for transportation of fluid from one of the chambers to the other. This is advantageous in that both sides of the fuel pump may be used for transporting fuel, which renders the pump more insensitive for fuel leakage past the piston. By a controllable fuel flow passage is meant that the passage is controllable in respect of how much fuel that may be transported from one of the chambers to the other, i.e. the size of an opening in the fuel flow passage may be varied. Further, the direction of the flow of fuel may be controlled.

The fluid flow passage may be arranged external of the first chamber and the second chamber which is advantageous in that a simple way of providing an opening between the two chambers is offered.

In one embodiment, the fluid flow passage may be configured to be substantially open when the piston decreases the volume of the first chamber, and be substantially closed when the piston increases the volume of the first chamber, the outlet valve of the second chamber and the inlet valve of the first chamber each being essentially open when the fluid flow passage is substantially closed. This is advantageous in that the pump may be used basically as a single sided pump, without causing excessive pressure build-up in any of the chambers.

The fluid flow passage may comprise a controllable valve for controlling the flow of fluid through the fuel flow passage, and the direction of through-flow of fluid may be selectable by the controllable valve which further increases the control options of the fluid pump.

The fluid pump may further comprise a first fluid line connected to the inlet valve of the first chamber, a second fluid line connected to the outlet valve of the first chamber, a third fluid line connected to the inlet valve of the second chamber, a fourth fluid line connected to the outlet valve of the second chamber, and a fluid circulation line comprising a valve and connecting any of the first fluid line with the second fluid line and the third fluid line with the fourth fluid line. This further increases the control options of the pump, since fluid may be circulated within a chamber.

At least one of the chambers may comprise any of a fluid pressure sensor for detecting a pressure in the chamber, and a position sensor for detecting a location of the piston. This facilitates detection of pressure levels that deviates from a predetermined level, or movement of the piston that deviates from a predetermined movement. Any of these deviations indicates a blocked or broken fluid line.

According to one embodiment of the invention, the fluid pump may be a fuel pump for transporting liquid fuel, a vapor recovery pump for transporting gaseous vapor, or a combination thereof.

According to another embodiment of the invention, a fuel dispensing unit for refueling vehicles is provided, comprising the fuel pump described above, wherein a fuel dispensing nozzle is connected to at least one of the two chambers via a fuel flow line, for transporting flammable fuel. The inventive fuel dispensing unit is, inter alia, advantageous in that it has a compact fuel pump that offers a flexible regulation of the rate of fuel dispensed via the fuel dispensing, nozzle.

The fuel dispensing unit may further comprise a second fuel pump incorporating any of the features described above, and a second fuel dispensing nozzle, wherein the first fuel dispensing nozzle is connected to both chambers of the first fuel pump, the second fuel dispensing nozzle being connected to both chambers of the second fuel pump. This configuration facilitates efficient control of the rate with which fuel is dispensed from the two fuel dispensing nozzles.

Alternatively, the fuel dispensing nozzle may be connected to the first chamber via a first fuel flow line, and a second fuel dispensing nozzle may be connected to the second chamber via a second fuel flow line, which reduces the amount of components in the fuel dispensing unit.

The fuel dispensing unit may further comprise a vapor suction nozzle arranged at the fuel dispensing nozzle, a fuel meter configured to measure an amount of fuel dispensed from the fuel dispensing nozzle, and a control device configured to regulate a vapor recovery pump connected to the vapor suction nozzle, such that the amount of recovered vapor substantially corresponds to the amount of dispensed fuel. By using, in practice, a rate of dispensed fuel as a control parameter for recovered vapor, a more environment friendly fuel dispenser is obtained.

According to still another implementation of the invention, a fuel dispensing unit for refueling vehicles is provided, comprising a vapor recovery pump as described above, wherein a vapor suction nozzle is connected to at least one of the two chambers via a vapor flow line, for transporting fuel vapor. The fuel dispensing unit having the fluid pump acting as a vapor recovery pump may incorporate features that correspond to the fuel dispensing unit having the fluid pump acting as a fuel pump.

According to still another implementation of the invention, a fuel dispensing unit is provided comprising a fluid pump as described above, wherein a vapor suction nozzle is connected to the second chamber via a vapor flow line, and a fuel dispensing nozzle is connected to the first chamber via a fuel flow line. The result may be that the vapor recovery rate automatically corresponds to the fuel dispensing rate, which eliminates the need of complex control means for the vapor recovery.

In one embodiment, in the configuration where a vapor suction nozzle is connected to the second chamber and a fuel dispensing nozzle is connected to the first chamber, the largest volume of the second chamber is bigger than the largest volume of the first chamber. This is advantageous in that the correspondence between the vapor recovery rate and the fuel dispensing rate is improved, since the situation where gaseous vapor is compressed to a greater extent than liquid vapor is handled.

BRIEF DESCRIPTION OF THE DRAWINGS

Embodiments of the present invention will now be described, by way of example, with reference to the accompanying schematic drawings, in which.

DETAILED DESCRIPTION

Figure 1:
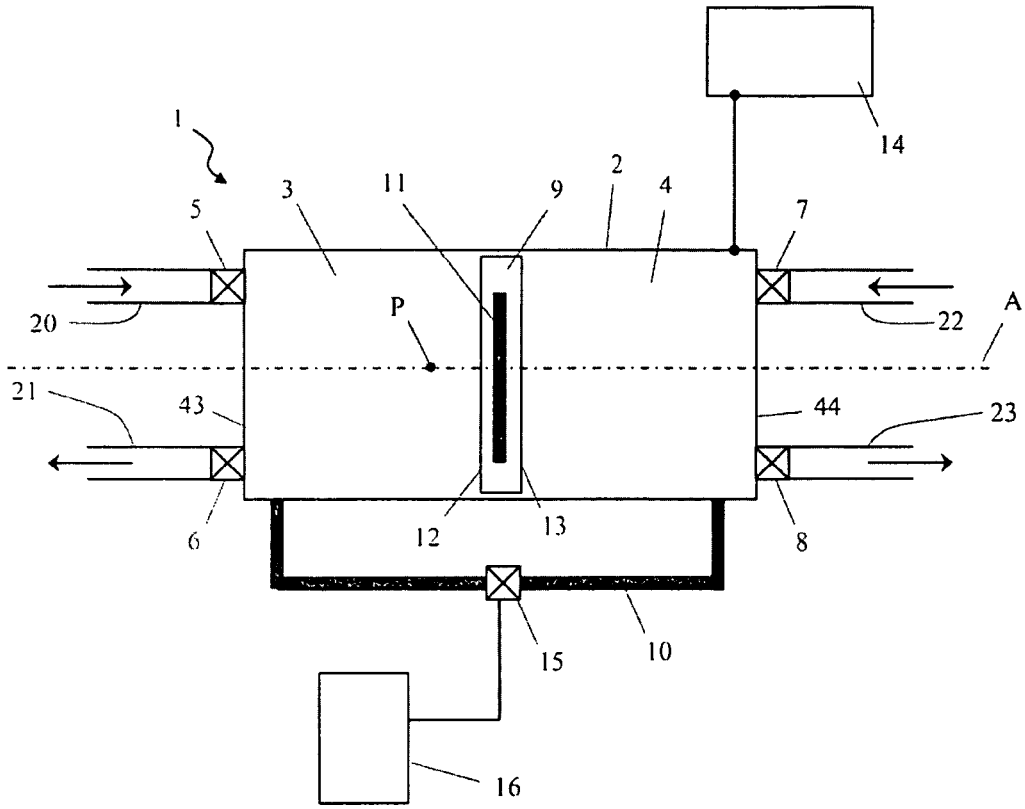
FIG. 1 is a schematic view of a fluid pump according to a first embodiment of the invention.

FIG. 1 illustrates a fluid pump 1 that has a pump housing 2 with first chamber 3 that is separated from a second chamber 4 by a piston 9 that is movable along a main axis A of the pump 1. The volume of each chamber 3, 4 depends on the location of the piston 1 but the total volume of the chambers 3, 4 is constant. The first chamber 3 has an inlet valve 5 and an outlet valve 6, and the second chamber 4 has a corresponding inlet valve 7 and a corresponding outlet valve 8.

A first fluid inlet line 20 is connected to the inlet valve 5 of the first chamber 3 and a first fluid outlet line 21 is connected to the outlet valve 6 of the first chamber 3, while a second fluid inlet line 22 is connected to the inlet valve 7 of the second chamber 4 and a second fluid outlet line 23 is connected to the outlet valve 8 of the second chamber 4.

The piston 9 has a magnetic device 11 arranged between a first side 12 and a second side 13 of the piston 9. Preferably the magnetic device 11 is a permanent magnet or an electromagnet.

Electromagnetic controller 14, which will be further described below, during operation of the pump 1 induces an electromagnetic field that repeatedly and alternately attracts the magnetic device 11 towards a first side 43 of the pump 1 and towards a second side 44 of the pump 1, which causes an alternating increase and decrease of the volume of the chambers 3, 4. The piston 9 moves back and forth along the axis A, which means that each side 12, 13 of the piston passes a common point P on the axis.

A fluid flow passage 10 is connected to the first chamber 3 near the first side 43 and to the second chamber 4 near the second side 44. The fluid flow passage has a valve 15 that is controlled by a control unit 16 in respect of how much fluid that may pass the fluid flow passage 10, and in which direction.

The control unit 16 may set the valve 15 to be fully open, completely closed, or to an opening degree ranging from fully open to completely closed. The control unit 16 may also set the through now direction of the valve 15. To achieve this the valve 15 preferably comprises a first non-return valve (not shown) that allows passage of fluid only from the first chamber 3 to the second chamber 4, and a second non-return valve (not shown) that allows passage of fluid only from the second chamber 4 to the first chamber 3. Each non-return valve may be selectively opened or closed by the control unit 16.

When the valve 15 is fully closed the pump 1 acts as a conventional double sided pump. However, when the valve 15 permits a flow of fluid from the first chamber 3 to the second chamber 4 via the fluid flow passage 10, and when the piston 9 moves towards the first side 43, then the outlet valve 6 of the first chamber 3 and the inlet valve 7 of the second chamber 4 remain closed during operation (since pressure levels necessary to open these valves 6, 7 are not reached). When the piston 9 thereafter moves to the second side 44, the inlet valve 5 of the first chamber 3 is opened for letting in fluid into the first chamber 3, while the outlet valve 8 of the second chamber 4 is opened for letting out fluid from the second chamber 4.

When the valve 15 permits a flow of fluid from the second chamber 4 to the first chamber 3 via the fluid flow passage 10, and when the piston 9 moves towards the second side 44, then the outlet valve 8 of the second chamber 4 and the inlet valve 5 of the first chamber 3 remains closed during operation (since pressure levels necessary to open these valves 5, 8 are not reached). When the piston 9 thereafter moves to the first side 43, then the inlet valve 7 of the second chamber 4 is opened for letting in fluid into the second chamber 4, while the outlet valve 6 of the first chamber 3 is opened for letting out fluid from the first chamber 3.

Hence it is possible to select which side of the pump shall draw fluid from a fluid source.

The pump 1 may also be used while keeping the fluid flow passage 10 closed. In this case the mode of operation is as follows. When the volume of the first chamber 3 is increased, the volume of the second chamber 4 is decreased. This causes a relatively lower pressure level in the first chamber 3, which causes its inlet valve 5 to open for letting in fluid, while a relatively higher pressure level is caused in the second chamber 4, which causes its outlet valve 8 to open for letting out fluid. Correspondingly, when the volume of the first chamber 3 is decreased, the volume of the second chamber 4 is increased, a relatively lower pressure level is caused in the second chamber 4, which causes its inlet valve 7 to open for letting in fluid, and a relatively higher pressure level is caused in the first chamber 3, which causes its outlet valve 6 to open for letting out fluid.

The described operation mode may e.g. be used when two fuel dispensing pistols with fuel nozzles/vapor recovery nozzles are operated at the same time as is described in connection with FIG. 6 below.

Figure 2:
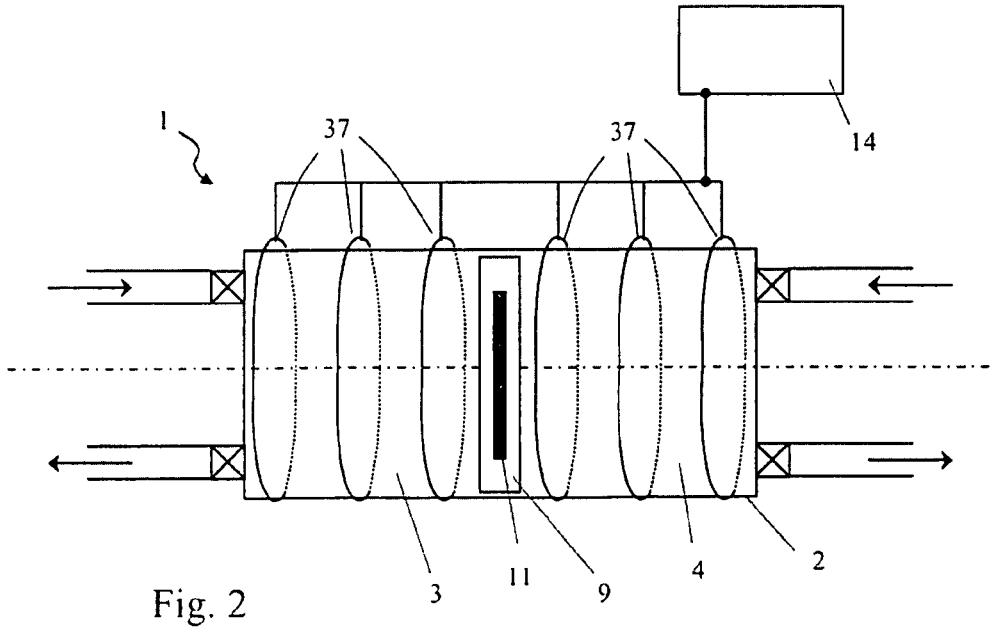
FIG. 2 is a schematic view of the inventive fluid pump comprising magnetic control means.

With reference to FIG. 2, the electromagnetic controller 14 may have a plurality of coils 37 arranged around the pump housing 2 circumferentially to the chambers 3, 4. Preferably the coils 37 are integrated in the pump housing 2. During operation of the pump 1, electrical currents are fed through the coils 37 which generate a magnetic field that attracts the piston 9, or more specifically, attracts the magnetic device 11 in the piston 9. By feeding electrical currents through coils near the first side 43 of the pump 1, the piston 9 is moved towards the first side 43. When the piston 9 is near the first side 43, electrical currents are fed through coils near the second side 44 of the pump 1, which causes the piston to move towards the second side 44. By repeatedly and rapidly altering current levels in the coils 37, the piston is moved back and forth.

Figure 3:
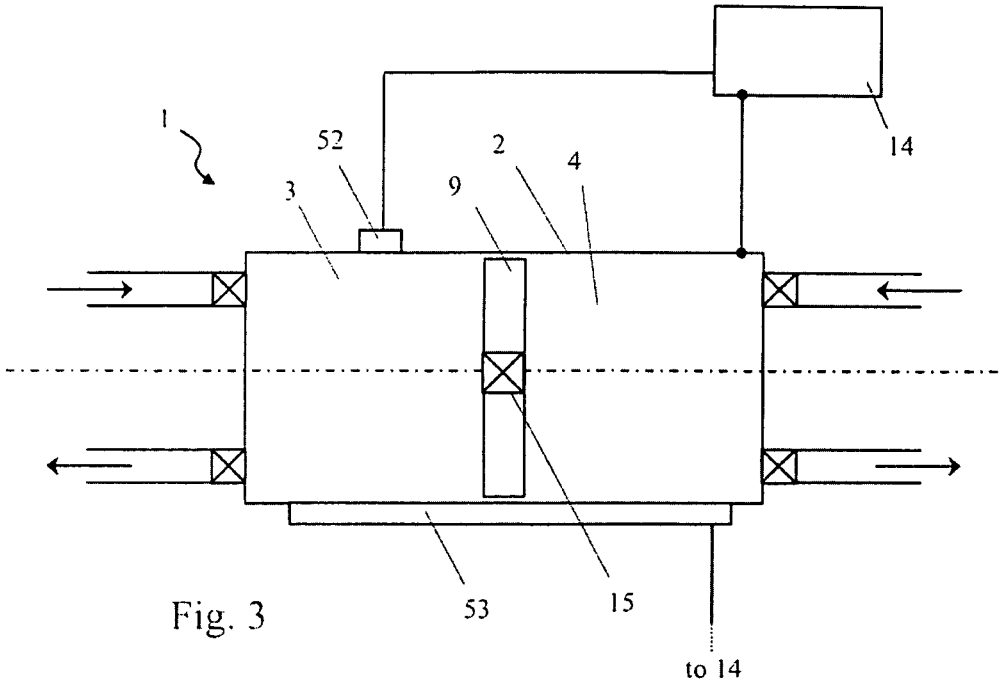
FIG. 3 is a schematic view of a fluid pump according to a second embodiment of the invention.

With reference to the embodiment of FIG. 3, the pump 1, the fluid flow passage and the valve 15 are incorporated in the piston 9. The control options (open, closed, direction of through flow) of the valves in this embodiment are identical to the valves of the previous embodiment. However, the valve 15 preferably comprises opening and closing members, which defile the control options which in turn are susceptible to a magnetic attraction force. The control of the opening and closing members is performed by a magnetic field generated in a suitable manner by the electromagnetic control means 14.

In one embodiment of the pump, a piston location sensor 53 extends the length of the housing 2 and detects the location of the piston 9. If the location deviates from an expected, pre-determined level, the pump 1 is stopped. Optionally a pressure sensor 52 is arranged, for example, at the first chamber 3 and detects the pressure in the chamber 3. If the pressure deviates from an expected, predetermined level, the pump 1 is stopped. Preferably, the sensors 52, 53 are connected to and communicate with the electromagnetic controller 14 in a conventional manner.

Figure 4:
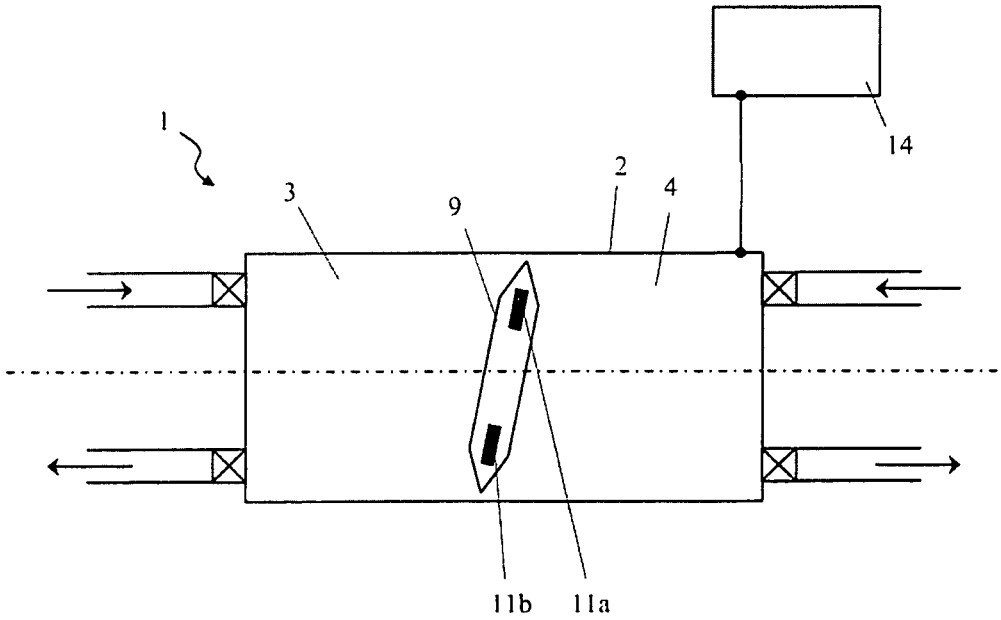
FIG. 4 is a schematic view of a fluid pump according to a third embodiment of the invention.

With reference to FIG. 4, in another embodiment of the pump 1, the piston 9 is tiltable such that a flow passage, or gap, is formed between the housing 2 and the piston 9, which allows fluid to pass directly from one chamber to the other. The functional effect of the tilting corresponds to the functional effect of the previously discussed valve 15. When the piston is to permit passage of fluid from one chamber to the other, it is tilted, otherwise it is not. This means that the piston 9 is tilted when it is moved in one direction, and un-tilted when it is moved in the other direction. The tilting is preferably achieved by arranging two magnetic devices 11*a* and 11*b* at opposite sides of the piston, and by applying, by the electromagnetic controller 14, suitable asymmetrical magnetic attraction forces to these magnetic devices 11*a*, 11*b*.

Figure 5:
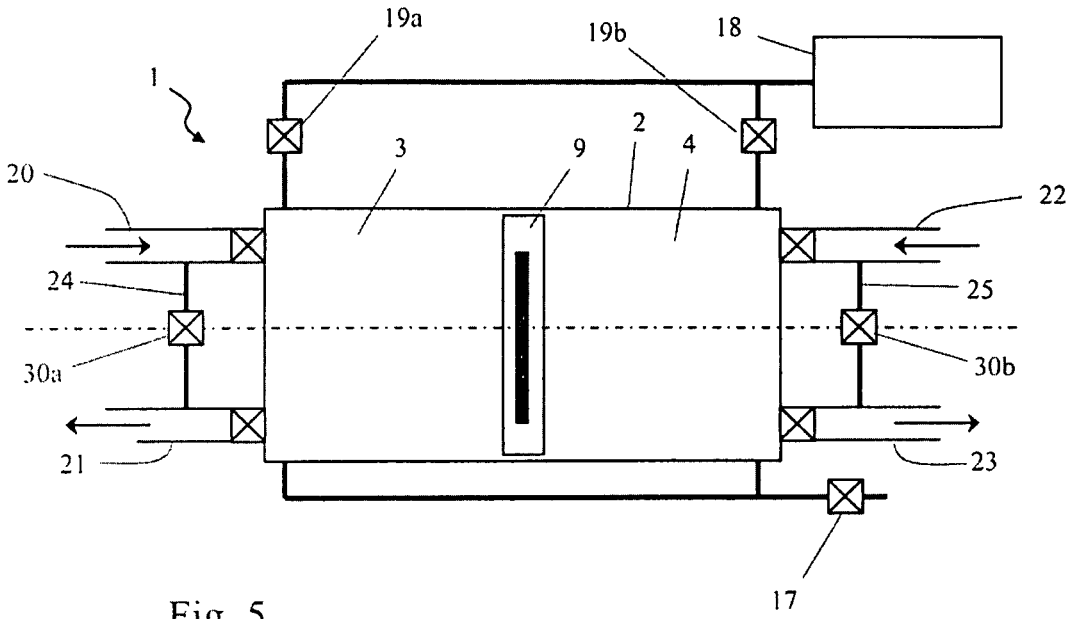
FIG. 5 is a schematic view of the inventive fluid pump comprising various means for reducing pressure in a chamber of the fluid pump.

With further reference to FIG. 5, an overflow valve 17 is shown connected, via a fluid flow line, to both the first chamber 3 and the second chamber 4. If the pressure in one of the chambers 3, 4 for some reason exceeds an undesirable level, the overflow valve 17 opens for preventing the pump 1 from being damaged by excessive pressure levels.

In one embodiment, the first chamber 3 is connected to a third chamber 18 via a controllable valve 19*a*, and the second chamber 4 is connected to the third chamber 18 via another controllable valve 19*b*. To reduce the relative level of pressure in any of the first 3 or second 4 chambers, corresponding valves 19*a* 19*b* are opened.

To allow regulation of fluid in the first chamber 3, a first fluid recirculation line 24 comprising a controllable valve 30*a* may be connected to the first fluid inlet line 20 and to the first fluid outlet line 21. In a corresponding manner a second fluid recirculation line 25 comprising a controllable valve 30*a* is connecting the second fluid inlet line 22 with the second fluid outlet line 23.

The valves 19*a*, 19*b*, 30*a* and 30*b* are, for example, connected to and controlled by the control unit 16.

Figure 6:
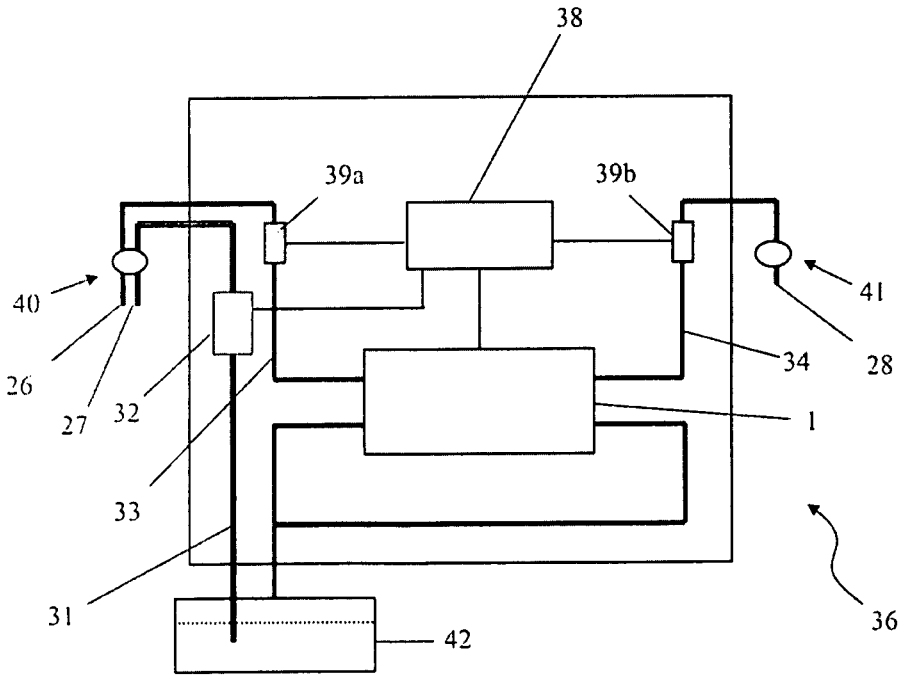
FIGS. 6-10 illustrate fuel dispensing units according to five different embodiments of the invention.

With reference to FIG. 6, a fuel dispensing unit 36 incorporates a fluid pump 1 according to the description above. In this embodiment, the fluid pump is arranged as a vapor recovery pump, and the fuel dispensing unit 36 has a conventional first fuel dispensing pistol 40 with a fuel dispensing nozzle 27 and a vapor recovery nozzle 26. The fuel dispensing nozzle 27 is, via a first fuel line 31 that has a fuel meter 32, in fluid communication with an underground fuel storage tank 42.

The fuel dispensing unit 36 shown also a has second fuel dispensing pistol 41 with a fuel dispensing nozzle (not shown) and a vapor recovery nozzle 28. The fuel dispensing nozzle is, via a second Fuel line (not shown) that has a fuel meter (not shown), in fluid communication with the underground fuel storage tank 42.

The vapor recovery nozzle 26 of the first pistol 40 is, via a first vapor recovery line 33, connected to the inlet valve of the first chamber of the pump 1. The vapor recovery line 33 has detector 39*a* that detects the level of hydrocarbon in the first recovery vapor line 33. The vapor recovery nozzle 28 of the second pistol 41 is, via a second vapor recovery line 34, connected to the inlet valve of the second chamber of the pump 1. The second vapor recovery line 34 has also a hydrocarbon-detector 39*b* for detecting the level of hydrocarbon in the vapor line 34.

The outlet valves of both chambers of the vapor recovery pump 1 are connected to the fuel storage tank 42 via suitable vapor flow lines.

A control device 38 is connected to the fuel meter 32, to the hydrocarbon-detectors 39*a*, 39*b* and to the vapor recovery pump control unit 16. Optionally, the vapor recovery pump control unit 16 is integrated in the control device 38.

When filling a vehicle by means of the first pistol 40, the rate of dispensed fuel is measured by the fuel meter 32. The control device 38 monitors the rate of dispensed fuel and sends a signal to the vapor recovery pump 1 setting the vapor recovering rate, or pumping rate, to be equal to the fuel dispensing rate. If the detector 39*a* detects a predetermined, low level of hydrocarbon content the vapor recovery pump may be stopped. When filling a vehicle by means of the second pistol 41, a corresponding operation is performed.

When only one of the pistols 40, 41 is used for dispensing fuel, the described vapor flow passage between the two chambers of the vapor recovery pump 1 is open, such that vapor is drawn into the chamber that has its inlet valve connected to the vapor recovery line that belongs to the pistol that is used. When both pistols 40, 41 are used at the same time, the flow passage between the two chambers is closed.

Figure 7:
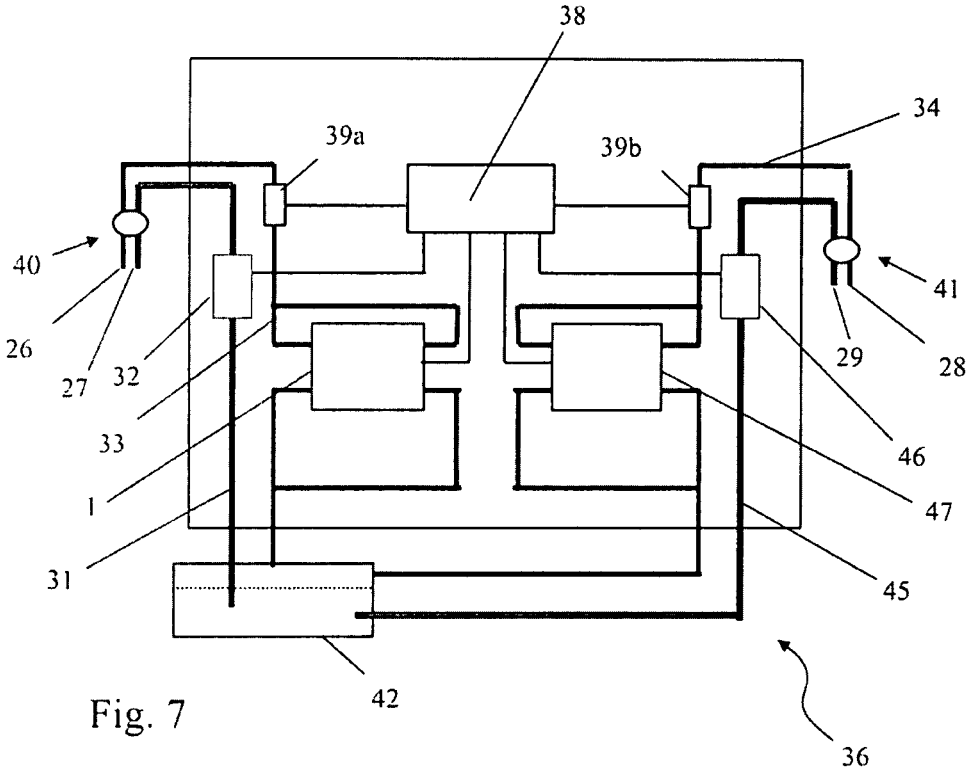

With reference to FIG. 7, another embodiment of a fuel dispensing unit 36 is illustrated. Here the first vapor suction nozzle 26 is connected to both chambers of a first vapor recovery pump 1 via a first vapor recovery line 33. The second vapor suction nozzle 28 is connected to both chambers of a second vapor recovery pump 47 via the second vapor recovery line 34. Both vapor recovery pumps 1 and 47 constantly operate as double-acting pumps, which results in a more simple control of the recovery of vapor. In FIG. 7, the fuel line 45, the fuel meter 46 and fuel dispensing nozzle 29 associated with the second fuel dispensing pistol 41 are illustrated.

Figure 8:
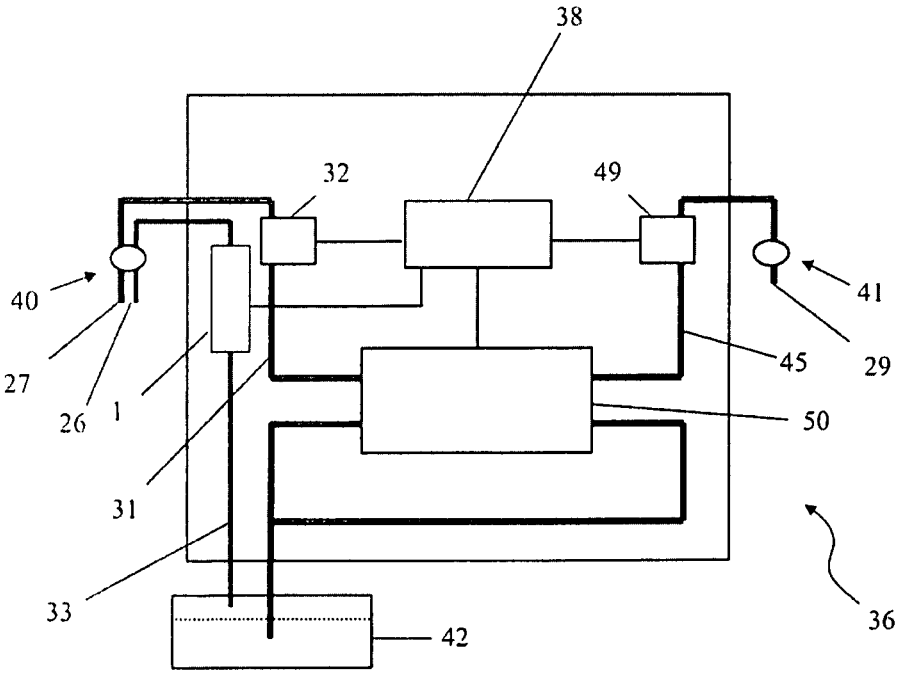

With reference to FIG. 8, another embodiment of a fuel dispensing unit 36 is illustrated, with like components having the same reference numerals as in previous figures. However, in this case a fluid pump is arranged as liquid fuel pump 50 while the vapor recovery pump 1 is illustrated more schematically. Here, the first fuel dispensing nozzle 27 is connected to the outlet valve of the first chamber of the fuel pump 50, while the second fuel dispensing nozzle 29 is connected to the outlet valve of the second chamber.

Figure 9:
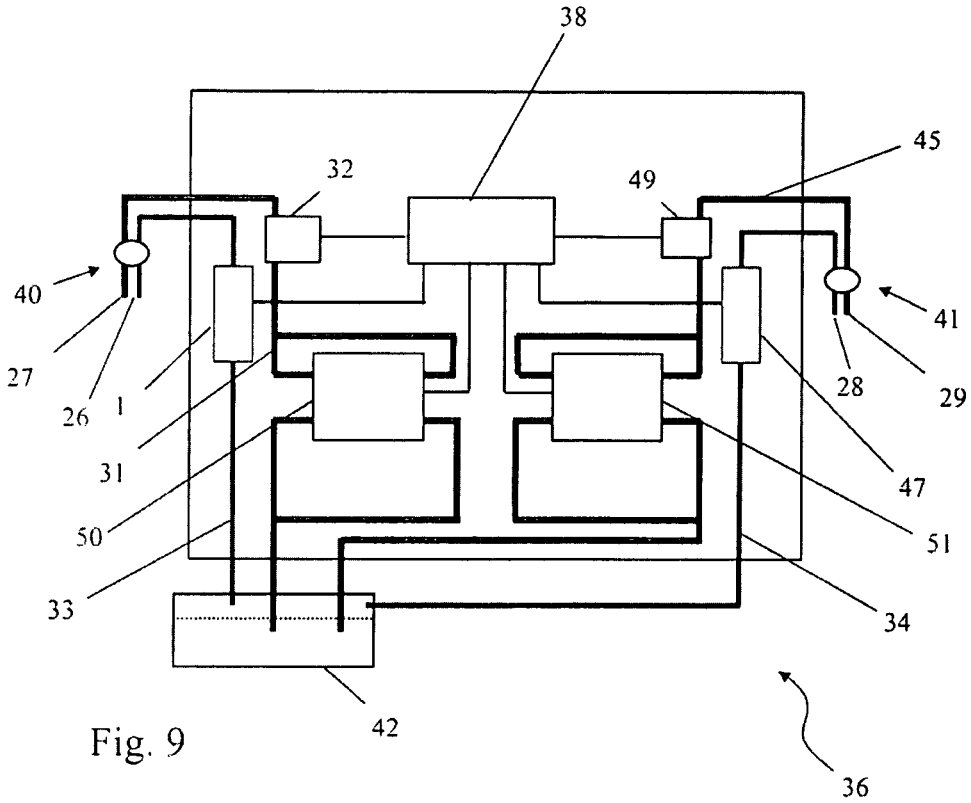

With reference to FIG. 9, yet another embodiment of a fuel dispensing unit 36 is illustrated, with like components having the same reference numerals as in previous figures. However, in this case two fluid pumps are arranged as liquid fuel pumps 50 and 51, and the vapor recovery pumps 1 and 47 are illustrated more schematically. Moreover, a second fuel meter 49 associated with the second fuel dispensing pistol 41 is illustrated. Here, the first fuel dispensing nozzle 27 is connected to the outlet valves of the first fuel pump 50, while the second fuel dispensing nozzle 29 is connected to the outlet valves of the second fuel pump 51.

Figure 10:
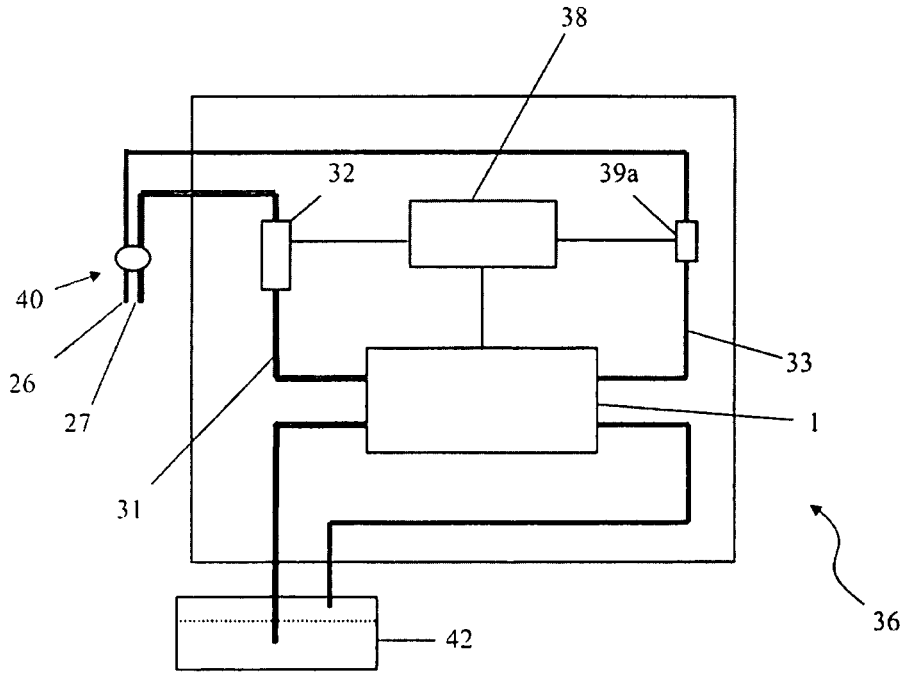

With reference to FIG. 10, yet another embodiment of a fuel dispensing unit 36 is illustrated, with like components having the same reference numerals as in previous figures. Here, the fluid pump 1 is arranged as both a liquid fuel pump and a vapor recovery pump. This is achieved by the fuel dispensing nozzle 27 being connected, via the fuel flow line 31, to the inlet valve of the first chamber of the pump 1, while the vapor recovery nozzle 26 is connected, via the vapor recovery line 33, to the inlet valve of the second chamber of the pump 1. In this embodiment the rate of recovered vapor automatically corresponds to the amount of dispensed fuel.

When a vehicle that is fitted with a system for on-board refueling vapor recovery is being refueled, no vapor should be recovered by the fuel dispensing unit. To handle this situation a valve (not shown) in the vapor line is closed by the control device 38.

A number of embodiments have been described, and several others have been mentioned or suggested. Furthermore, those skilled in the art will readily recognize that a variety of additions, deletions, alterations, and substitutions may be made to these embodiments while still embracing die concept of the invention. Thus, the scope of protected subject matter should be judged based on the following claims, which may capture one or more aspects of one or more embodiments.

The invention claimed is:

1. A fluid pump for a fuel dispensing unit comprising:

a pump housing with a first chamber having a first side and a second chamber having a second side;

a first fluid inlet and a first fluid outlet coupled to the first chamber;

a first outlet valve disposed on the first fluid outlet;

a second fluid inlet and a second fluid outlet coupled to the second chamber;

an inlet valve disposed on the second fluid inlet;

the first chamber and the second chamber being separated by a movable piston having a cross sectional area and arranged to repeatedly decrease and increase a volume of the first chamber and a volume of the second chamber, the piston comprising a magnetic device, wherein an electromagnetic controller is configured to move the piston by altering a magnetic field, for repeatedly-decreasing and increasing the volume of the first chamber and the volume of the second chamber;

a fluid flow passage directly connected to first chamber near the first side and to the second chamber near the second side, the fluid flow passage permitting fluid to flow from the first chamber to the second chamber without passing through any of the first fluid inlet, the first fluid outlet, the second fluid inlet and the second fluid outlet; and a control unit that controls how much fluid passes from the first chamber through the fluid flow passage to the second chamber.

2. A fluid pump according to claim 1, wherein the movable piston has a first piston side facing the first chamber and a second piston side facing the second chamber, wherein the magnetic device is arranged between the first piston side and the second piston side.

3. A fluid pump according to claim 2, wherein the first piston side and the second piston side each passes a common point along a direction of movement of the piston, when the volume of the first chamber and the volume of the second chamber are repeatedly decreased and increased.

4. A fluid pump according to claim 1, wherein the greatest cross sectional area of the piston in a plane along a direction of movement of the piston is smaller than the cross sectional area of the first chamber and the second chamber.

5. A fluid pump according to claim 1, wherein the pump housing comprises a plurality of coils fed by a current for moving the piston, the electromagnetic controller being configured to repeatedly vary current levels applied to the plurality of coils, so that the movement of the piston is controllable in respect of its location and speed.

6. A fluid pump according to claim 5, wherein the plurality of coils are circumferential to the first chamber and the second chamber.

7. A fluid pump according to claim 1, wherein the magnetic device is a permanent magnet.

8. A fluid pump according to claim 1, wherein the fluid flow passage is arranged external of the first chamber and the second chamber.

9. A fluid pump according to claim 1, wherein the fluid flow passage is configured to be substantially open when the piston decreases the volume of the first chamber, and be substantially closed when the piston increases the volume of the first chamber.

10. A fluid pump according to claim 1, wherein the fluid flow passage comprises a controllable valve.

11. A fluid pump according to claim 1, further comprising
a first fluid line connected to the first fluid inlet,
a second fluid line connected to the first fluid outlet,
a third fluid line connected to the second fluid inlet,
a fourth fluid line connected to the second fluid outlet, and
a fluid circulation line comprising a valve and connecting any of the first fluid line with the second fluid line and the third fluid line with the fourth fluid line.

12. A fluid pump according to claim 1, wherein at least one of the first chamber and second chamber comprises any of a fluid pressure sensor for detecting a pressure in the first chamber or the second chamber, and a position sensor for detecting a location of the piston.

13. A fluid pump according to claim 1, wherein the fluid pump is a fuel pump.

14. A fluid pump according to claim 1, wherein the fluid pump is a vapor recovery pump.

15. A fuel dispensing unit for refueling vehicles, comprising
a first fuel pump for a fuel dispensing unit, comprising
a pump housing with a first chamber having a first side and a second chamber having a second side;
a first fluid inlet and a first fluid outlet coupled to the first chamber;
a first outlet valve disposed on the first fluid outlet;
a second fluid inlet and a second fluid outlet coupled to the second chamber;
an inlet valve disposed on the second fluid inlet
the first chamber and the second chamber being separated by a movable piston arranged to repeatedly decrease and increase a volume of the first chamber and a volume of the second chamber, the piston comprising a magnetic device;
a fluid flow passage directly connected to first chamber near the first side and to the second chamber near the second side, the fluid flow passage permitting fluid to flow from the first chamber to the second chamber without passing through any of the first fluid inlet, the first fluid outlet, the second fluid inlet and the second fluid outlet;
a control unit that controls how much fluid passes from the first chamber through the fluid flow passage to the second chamber; and
a fuel dispensing nozzle connected to at least one of the first chamber and the second chamber via a fuel flow line, for transporting fuel.

16. A fuel dispensing unit according to claim 15, further comprising
a second fuel pump for a fuel dispensing unit, comprising
a pump housing with a first chamber having a first side and a second chamber having a second side,
the first having a first fluid inlet and a first fluid outlet;
the second chamber having a second fluid inlet and a second fluid outlet;
the first chamber and the second chamber being separated by a movable piston arranged to repeatedly decrease and increase the volume of the first chamber and the volume of the second chamber, the piston comprising a magnetic device and
a fluid flow passage directly connected to first chamber near the first side and to the second chamber near the second side, the fluid flow passage permitting fluid to flow from the first chamber to the second chamber without passing through any of the first fluid inlet, the first fluid outlet, the second fluid inlet and the second fluid outlet;
a control unit that controls how much fluid passes from the first chamber to the second chamber; and
a second fuel dispensing nozzle, wherein the first fuel dispensing nozzle is connected to first chamber and the second chamber of the first fuel pump and the second fuel dispensing nozzle is connected to first chamber and the second chamber of the second fuel pump.

17. A fuel dispensing unit according to claim 15, wherein said fuel dispensing nozzle is connected to the first chamber via a first fuel flow line, and a second fuel dispensing nozzle is connected to the second chamber via a second fuel flow line.

18. A fuel dispensing unit according to claim 15, further comprising a vapor suction nozzle arranged at the fuel dispensing nozzle, a fuel meter configured to measure an amount of fuel dispensed from the fuel dispensing nozzle, and a control device configured to regulate a vapor recovery pump connected to the vapor suction nozzle, such that the amount of recovered vapor substantially corresponds to the amount of fuel dispensed.

19. A fuel dispensing unit for refueling vehicles, comprising a vapor recovery pump according to claim 14, wherein a vapor suction nozzle is connected to at least one of the first chamber and the second chamber via a vapor flow line, for transporting fuel vapor.

20. A fuel dispensing unit for refueling vehicles, comprising a fluid pump according to claim 1, wherein a vapor suction nozzle is connected to the second chamber via a vapor flow line, and a fuel dispensing nozzle is connected to the first chamber via a fuel flow line.

21. A fuel dispensing unit according to claim 20, wherein a largest volume of the second chamber is greater than a largest volume of the first chamber.

* * * * *